US005333683A

United States Patent [19]

Arriulou et al.

[11] Patent Number: 5,333,683

[45] Date of Patent: Aug. 2, 1994

[54] INDIRECT HEAT EXCHANGER

[75] Inventors: Pascal Arriulou, Saint Maurice; Alain Grelaud, La Queue En Brie; Francois Venet, Paris, all of France

[73] Assignee: L'Air Liquide, Societe Anonyme Pour L'Etude Et L'Exploitation Des Procedes Georges Claude, Paris, France

[21] Appl. No.: 989,387

[22] Filed: Dec. 11, 1992

[30] Foreign Application Priority Data

Dec. 11, 1991 [FR] France ..... 91 15381

[51] Int. Cl.[5] ..... F17C 9/02

[52] U.S. Cl. ..... 165/166; 62/50.2

[58] Field of Search ..... 165/110, 166; 62/36, 62/42, 50.2

[56] References Cited

U.S. PATENT DOCUMENTS

| | | | |
|---|---|---|---|
| 3,256,704 | 6/1966 | Becker | 62/42 |
| 3,633,661 | 1/1972 | Duncan et al. | 165/166 X |
| 3,880,231 | 4/1975 | Gauthier | 165/110 X |
| 3,992,168 | 11/1976 | Toyama et al. | 165/166 X |
| 4,249,595 | 2/1981 | Butt | 165/110 |
| 4,380,907 | 4/1983 | Barnes et al. | 62/50.2 |
| 4,450,903 | 5/1984 | Butt | 165/110 |
| 4,715,431 | 12/1987 | Schwarz et al. | 165/110 |
| 4,715,433 | 12/1987 | Schwarz et al. | 62/36 X |
| 4,721,164 | 1/1988 | Woodward | 62/36 X |
| 4,899,808 | 2/1990 | Gregory et al. | 165/110 X |
| 5,144,809 | 9/1992 | Chevalier et al. | 165/166 X |

FOREIGN PATENT DOCUMENTS

| | | | |
|---|---|---|---|
| 0019508 | 11/1980 | European Pat. Off. . | |
| 0130122 | 1/1985 | European Pat. Off. . | |
| 2237158 | 2/1975 | France . | |
| 2431103 | 2/1980 | France . | |
| 63-143486 | 10/1988 | Japan . | |
| 402068475 | 3/1990 | Japan | 62/36 |

*Primary Examiner*—John Rivell

*Attorney, Agent, or Firm*—Young & Thompson

[57] ABSTRACT

Indirect heat exchanger, of the type comprising a series of parallel plates (7) delimiting between themselves passages (8A, 8B; 28, 42, 60) of generally plate form containing undulant spacers (9; 32, 34, 36, 37, 44, 47, 48, 53 to 56). A first assembly (8A; 28, 60) of these passages constitutes thermal exchange passages having structure (3 to 5; 39 to 41, 51) for inlet and outlet of fluids adapted to exchange heat with each other. Over at least a portion of its length and of its width, the exchanger has added passages (8B; 42), in reduced or no heat exchange relation with the thermal exchange passages (8A; 28, 60) and provided to fulfill at least one function in addition to the exchange of heat, namely a function of storing liquid and/or recirculation of liquid and/or liquid-vapor separation.

10 Claims, 8 Drawing Sheets

FIG.13
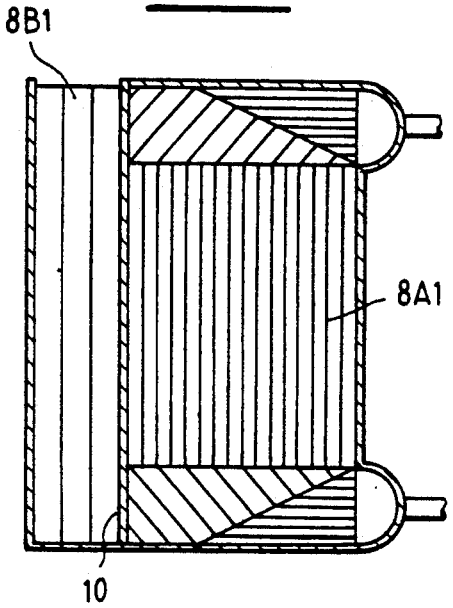
FIG.14
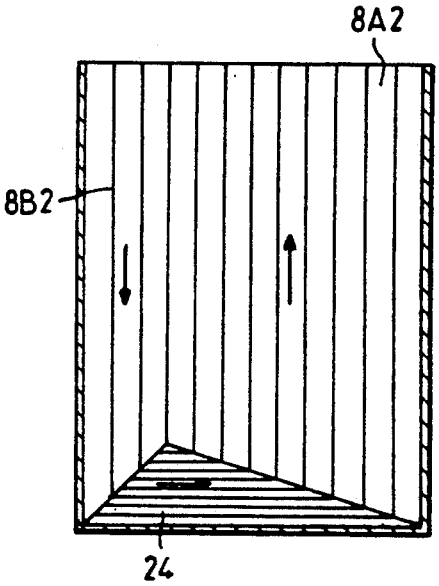
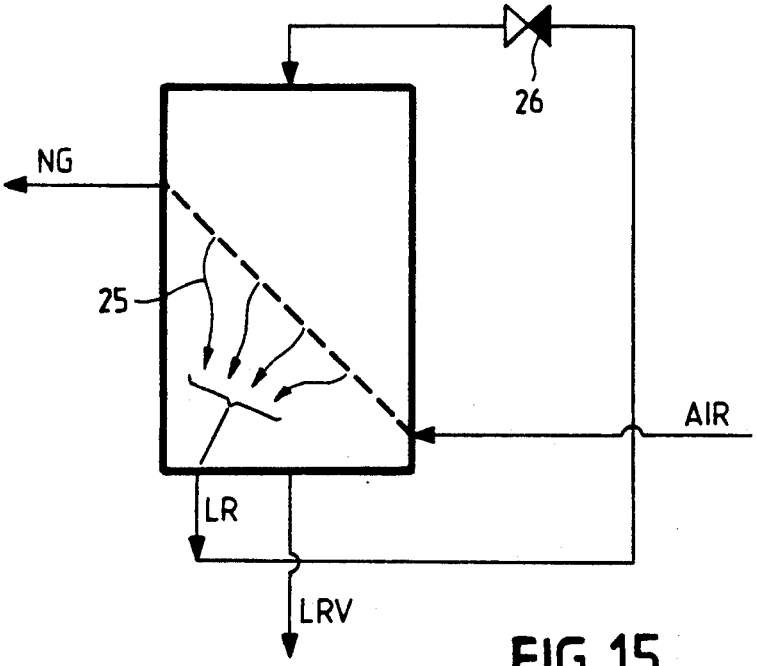
FIG.15

INDIRECT HEAT EXCHANGER

FIELD OF THE INVENTION

The present invention relates to plate-type indirect heat exchangers, which is to say of the type comprising a series of parallel plates delimiting between them passages of general plate shape containing undulant crosspieces, a first assembly of these passages, constituting thermal exchange passages, comprising inlet/outlet means for fluids to be heat exchanged with each other.

BACKGROUND OF THE INVENTION

These heat exchangers are rational to construct. Thus, it suffices to stack all their elements (plates, undulant members serving as crosspieces and ribs, closure strips of the passages) and to connect them to each other in a single operation by brazing in a furnace.

However, this advantage is in practice partially lost by the need to connect to the exchanger numerous accessories, such as valves or phase separators, ensuring the auxiliary functions of the exchanger: recirculation of the liquid, stabilization of the liquid feed, separation of the phases of the two phase fluids, etc. Moreover, in numerous cases, it is necessary to position the exchanger in a liquid retention chamber such as the base of a distillation column. All these operations constitute metal working operations of lower output than brazing in a furnace.

SUMMARY OF THE INVENTION

The invention has for its object to reduce the metal working operations associated with the production of plate-type heat exchangers.

To this end, the invention has for its object an indirect heat exchanger of the described type, characterized in that it comprises, over at least a part of its length and width, added passages of reduced or almost no heat exchange relation with the thermal exchange passages and adapted to perform at least one function in addition to heat exchange, particularly a function of storing liquid and/or recirculation of liquid and/or of liquid-vapor separation.

According to other characteristics:

the added passages are thicker than the thermal exchange passages;

the added passages contain undulations of greater pitch than those of the thermal exchange passages;

all the added passages are adjacent to each other;

the added passages are distinct from the thermal exchange passages and, like these latter, each extend over all the length and width of the exchangers;

at least certain passages of the exchanger constitute over a portion of the width of the latter a thermal exchange passage and over the rest of the width an added passage;

at least certain passages of the exchanger constitute over a portion of the length of this latter a thermal exchange passage and over the rest of its length an added passage;

the added passages comprising liquid-vapor separation passages, these separation passages contain a filler for liquid-vapor separation disposed facing an inlet opening for a two-phase liquid;

the filling is constituted by a "serrated" undulant member with oblique generatrices;

the liquid-vapor separation passages comprise at their upper end a vapor outlet opening capped by an outlet chamber, this latter communicating with the return passages for vapor to a different level of the exchanger.

BRIEF DESCRIPTION OF THE DRAWINGS

Examples of embodiment of the invention will now be described with regard to the accompanying drawings, in which:

FIGS. 13 and 14 are views similar respectively to FIGS. 7 and 8 of yet another modification of the heat exchanger of FIG. 6;

FIG. 15 shows schematically an application of a third embodiment of the heat exchanger according to the invention;

DETAILED DESCRIPTION OF THE INVENTION

Figure 1:
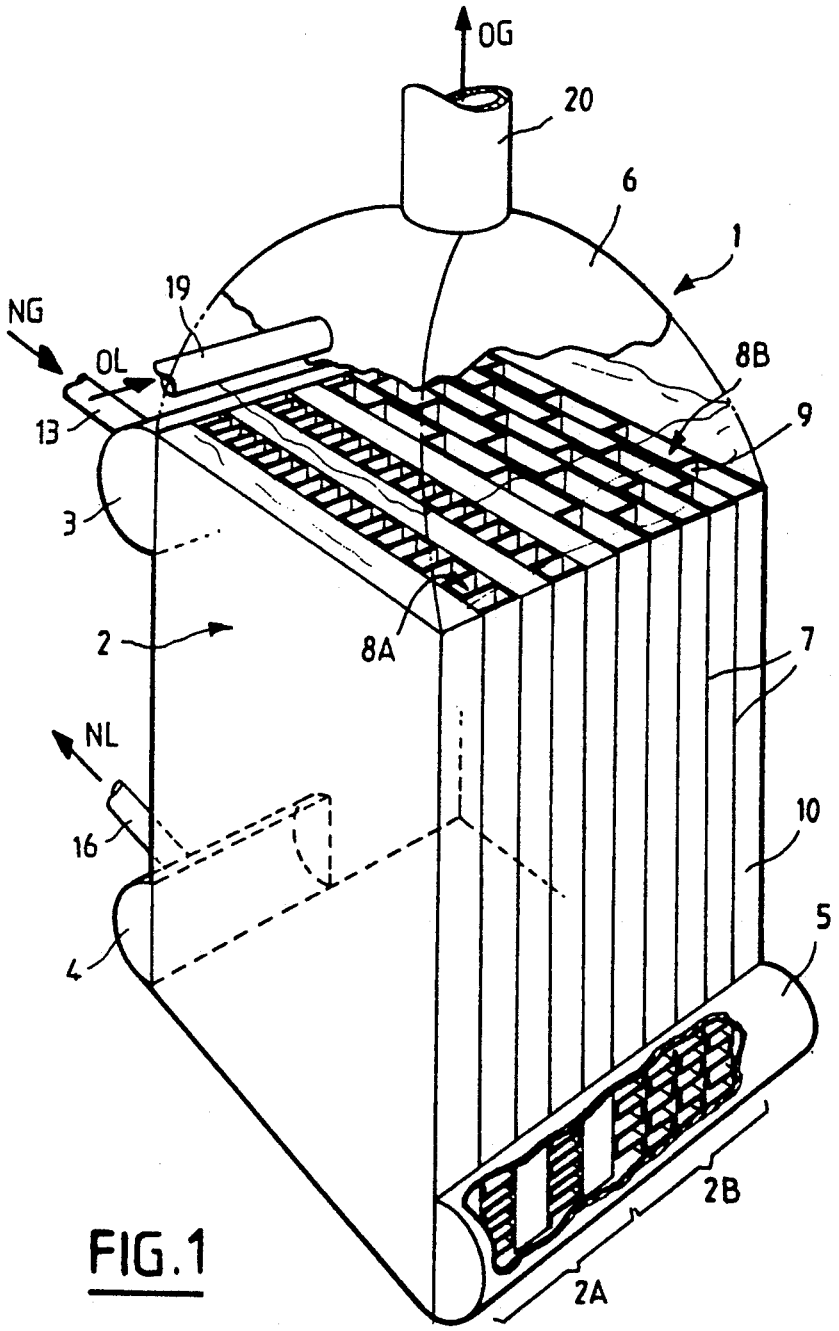
FIG. 1 shows in perspective, with parts broken away, a heat exchanger according to the invention.

The heat exchanger shown in FIGS. 1–4 is a liquid vaporizer of the thermal siphon type. It will be described as to its use as a principal vaporizer-condenser in a double air distillation column, placing in heat exchange relation gaseous nitrogen at the head of the medium pressure column, under about six bars absolute, and the liquid oxygen at the base of the low pressure column, under about one bar absolute, so as to vaporize the oxygen while condensing the nitrogen.

The exchanger 1 comprises a parallelepipedal body 2 of aluminum, assembled in a single operation by brazing in a furnace, three semi-cylindrical boxes 3 to 5 for inlet and outlet of fluids, and an upper dome 6, the elements 3 to 6 being secured by sealed joints on the body 2 by welding.

The body 2 is constituted by a large number of vertical parallel plates 7 between which are delimited passages 8 of generally plate form containing undulant spacers 9 with vertical generatrices. These passages are delimited by closure strips 10 indicated by heavy lines on FIGS. 2–4. In what follows, the "lengths" will designate the vertical dimension of body 2, the "thickness" its horizontal dimension perpendicular to the plates 7, and its "width" its horizontal dimension parallel to these plates.

The body 2 is constituted of two juxtaposed parts: at the left of FIG. 1, the heat exchange part 2A, and to the right an added part 2B performing auxiliary functions of recirculation of liquid, liquid-vapor separation, storage of liquid and uniform feed of liquid to the part 2A.

Figure 2:
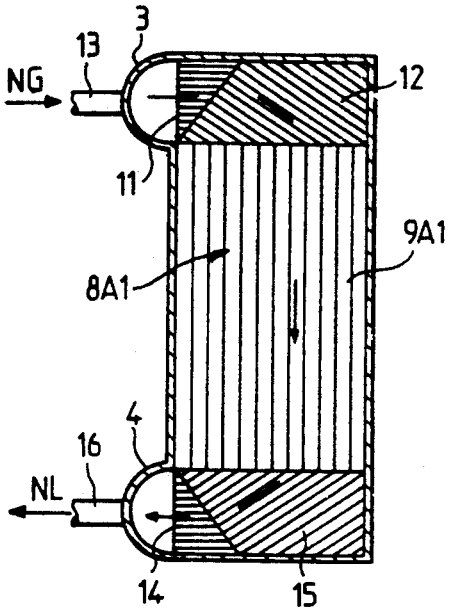
FIGS. 2–4 represent respectively, in vertical cross section, the three types of passages of this exchanger.
Figure 3:
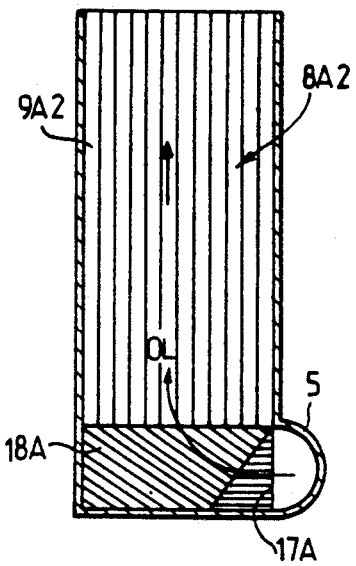

The passages 8A of part 2A are alternatively of two different types, shown respectively in FIGS. 2 and 3:

(1) passages 8A-1 for nitrogen condensation, closed over all their widths and height and at the bottom, which comprise laterally at their upper end an inlet opening 11 for gaseous nitrogen and, facing this, an oblique undulation 12 for distribution of this gaseous nitrogen over all the width of the passage. The box 3 described above covers all the openings 11 and is fed with gaseous nitrogen by a feed conduit 13. The passages 8A-1 comprise laterally, on the same side and at their lower end, an outlet opening 14 for liquid nitrogen and, opposite this latter, an oblique undulation 15 for collection of this liquid nitrogen opening on the opening 14. The box 4 described above covers all the openings 14 to collect the liquid nitrogen leaving these latter and to evacuate it via a conduit 16.

(2) passages 8A-2 for oxygen vaporization, closed over all their width at the bottom but open over all their width at the top, which comprise laterally of their lower end an opening 17A for entry of liquid oxygen, and facing this latter, an oblique undulation 18A for distribution of this liquid oxygen over all the width of the passage. The box 5 described above covers all the openings 17A.

Figure 4:
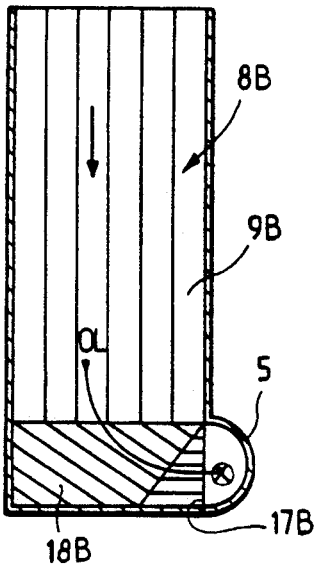

The passages 8B of the part 2B, shown in FIG. 4, have the same construction as the oxygen vaporization passages 8A-2, their openings 17B communicating also with the box 5. However, their vertical undulations 9B have a greater pitch than the undulations 9A-1 of the passages 8A-1 and greater than the undulations 9A-2 of the passages 8A-2, thanks to a greater pitch of undulation, and/or their thickness is greater than that of the passages 8A-1 and of the passages 8A-2.

It will be seen from the above description that the box 5 extends over all the thickness of the body of the exchanger, that is to say it covers its two parts 2A and 2B, while the boxes 3 and 4 extend only over that of the part 2A.

The dome 6 is connected along all four sides of the upper base of the parallelepiped formed by the body 2. It is provided with a feed conduit 19 for liquid oxygen and an outlet conduit 20 for gaseous oxygen which leaves through its summit.

In operation, the gaseous nitrogen is condensed under about six bars absolute while descending through the passages 8A-1, and the passages 8A-2 and 8B are filled with liquid oxygen under about one bar absolute, to a level situated in the dome 6, as is seen in FIG. 1.

The heat of condensation of the nitrogen boils the liquid oxygen contained in the passages 8A-1, which effects an ascending circulation of the liquid oxygen in these passages by a thermosiphon effect. Bubbles of gaseous oxygen form progressively in an upward direction in the same passages, such that it is a two-phase mixture which leaves the upper end of these passages.

The liquid oxygen cannot descend in the passages 8A-2, in which circulation is upward, nor in the passages 8A-1, which are upwardly closed, but descends in the passages 8B and, at the lower end of these latter, enters the box 5 via the lateral opening 17B (FIG. 4). This liquid oxygen then flows along the box 5 to the openings 17A which are inlets to the passages 8A-2 (FIG. 3), such that these latter are fed with liquid oxygen.

The passages 8B therefore ensure the recirculation of excess liquid oxygen, the separation of the two phases of the oxygen, and storage of liquid oxygen permitting feeding without interruption and in a uniform manner, liquid oxygen to the vaporization passages 8A-2.

In most of the passages 8B, the ascending circulation of liquid oxygen is not hindered by any phenomenon of vaporization, because these passages are not in thermal exchange relation with the nitrogen passages. The situation is slightly different for the passage 8B adjacent to part 2A of body 2, where the thermal exchange there is reduced substantially, on the one hand by the proximity of a passage 8A-2, and on the other hand by the greater thickness of the passages 8B and/or by the larger pitch of the undulation 9B, leading to a reduced vane effect.

Figure 5:
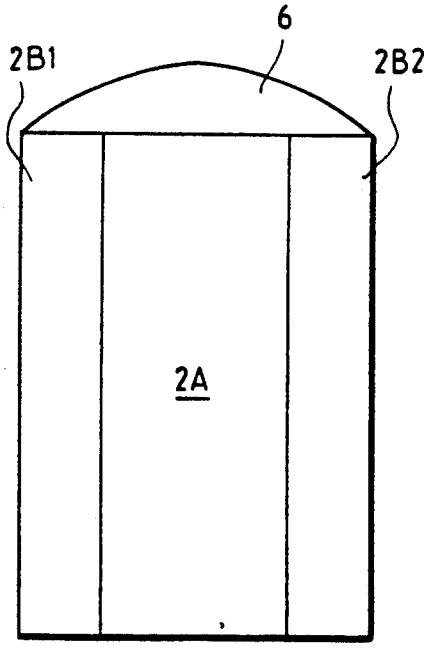
FIG. 5 shows schematically a modification of the same exchanger.

The modification of FIG. 5 differs from that which has been described only by the fact that the part 2B of body 2 is divided in two subparts 2B-1 and 2B-2 enclosing the thermal exchange part 2A. This shows that the auxiliary passages 8B can be distributed in different ways. However, the arrangement of FIG. 1 is preferred in practice, in which the heating of the passages 8B is minimal.

Figure 6:
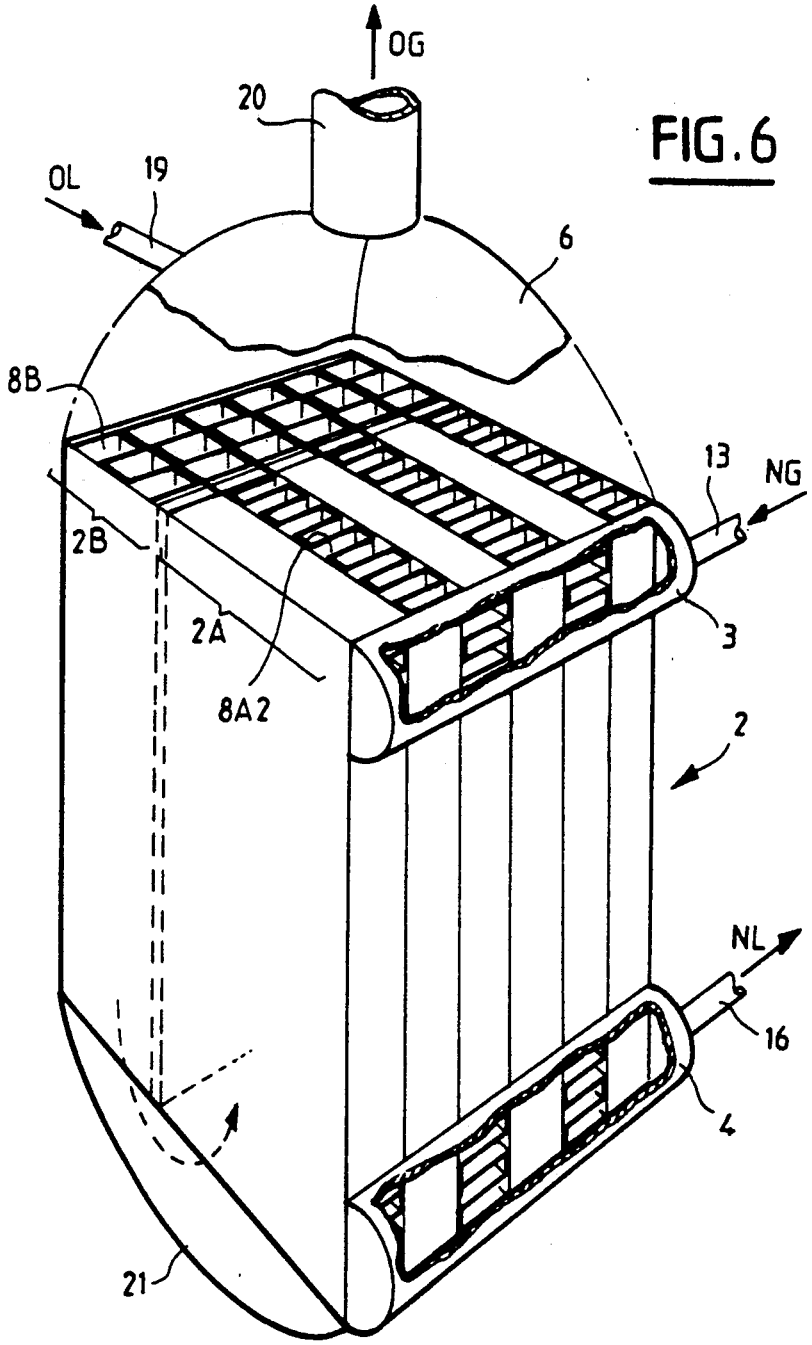
FIG. 6 is a view like that of FIG. 1, of a second embodiment of the heat exchanger according to the invention.
Figure 7:
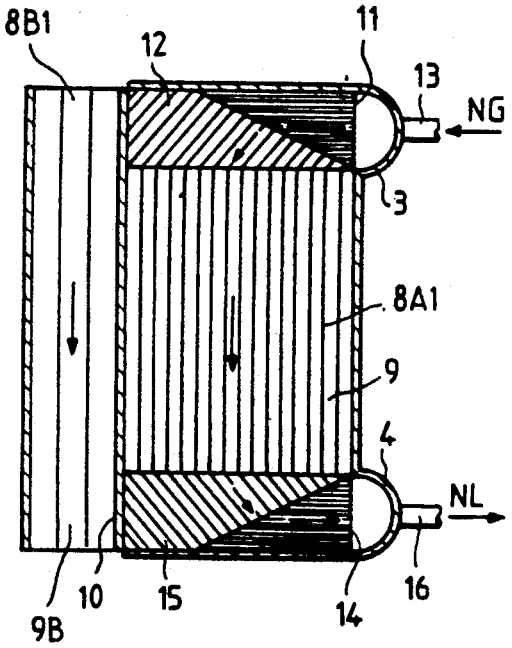
FIGS. 7 and 8 show respectively, in vertical cross section, the two types of passages of this exchanger.
Figure 8:
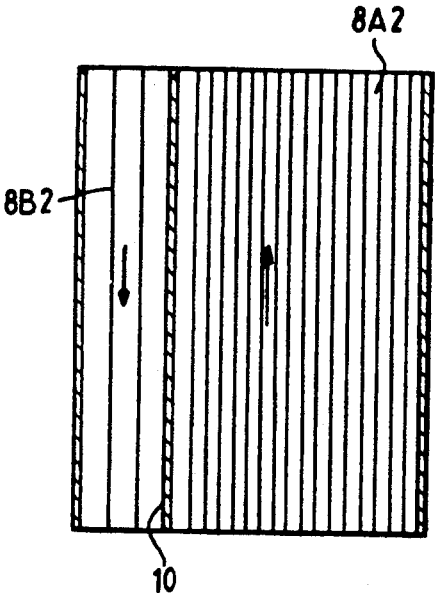

The embodiment of the heat exchanger shown in FIGS. 6–8 differs essentially from the preceding by the fact that the parts 2A and 2B of the body 2 are no longer distributed along the thickness of the exchanger, but along its width, which is to say that a part of each passage 8 serves for heat exchange and the rest for added functions.

Thus, one out of two passages is constituted, over the majority of its width (FIG. 7), by a nitrogen condensation passage 8A-1 having the construction described above with respect to FIG. 2, and, over the rest of its width, with an added passage 8B-1 open at the top and bottom and containing a simple vertical undulation 9B, passages 8A-1 and 8B-1 being separated in sealed fashion over all the length of the body 2 by a vertical strip 10.

The other passages are constituted (FIG. 8) by an oxygen vaporization passage 8A-2 open at its two ends, of the same width as the passages 8A-1 and located facing these latter, this passage 8A-2 containing a simple vertical undulation, and by an added passage 8B-2 analogous to passages 8B-1, with the interposition of a vertical strip 10 between the passages 8A-2 and 8B-2.

The box 5 of FIG. 1, adapted to feed liquid oxygen to passages 8A-2, is omitted and replaced by a lower dome 21 connected by a sealed joint to the four lower sides of the body 2. Thus, the passages 8A-2 are fed with liquid oxygen directly from the bottom.

Figure 9:
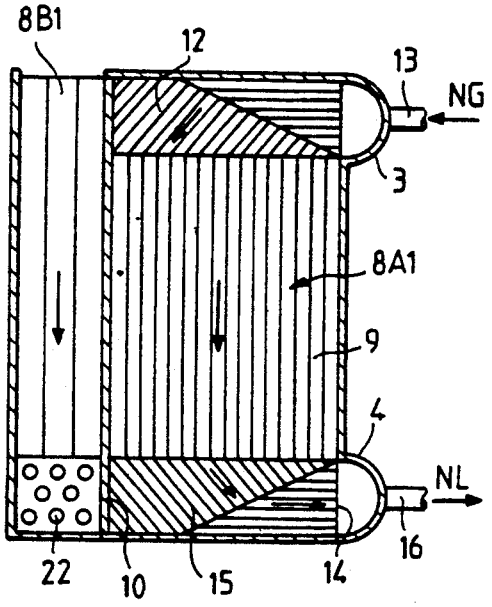
FIGS. 9 and 10 are views similar respectively to FIGS. 7 and 8, of a modification of the heat exchanger of FIG. 6.
Figure 10:
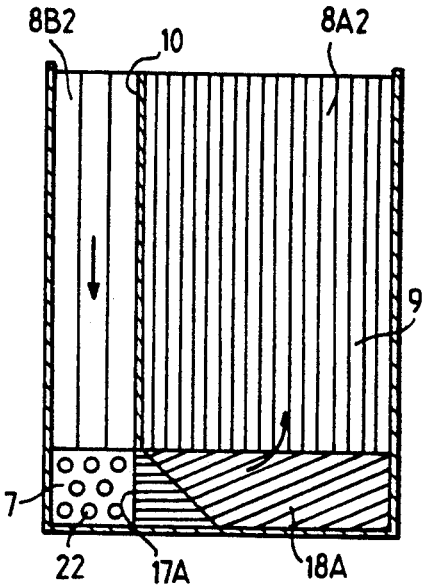

As a modification (FIGS. 9 and 10), the passages 8B-1 are closed downwardly and the lower dome 21 is replaced by perforations 22 provided in the lower part of the plates 7, in the passages 8B-1. The liquid oxygen then passes through the vaporization passages 8A-2 via a lateral opening 17A provided at the base of one out of two strips 10, then is divided by an oblique undulation 18A along the length of the passages 8A-2, in the same manner as in FIG. 3.

Figure 11:
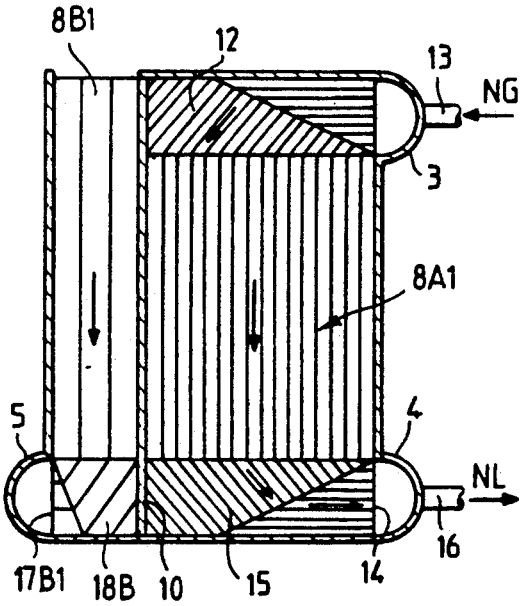
FIGS. 11 and 12 are views similar respectively to FIGS. 7 and 8 of another modification of the heat exchanger of FIG. 6.
Figure 12:
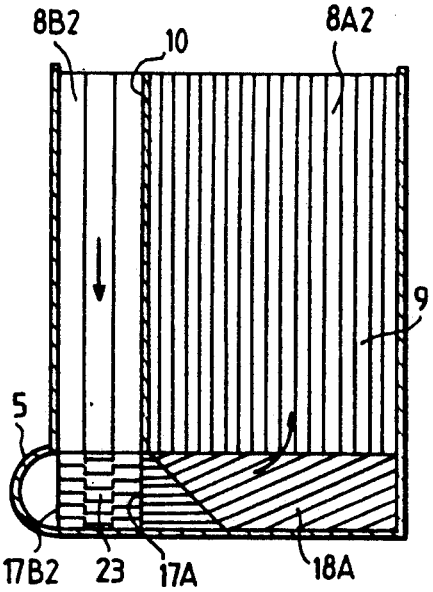

This variation can be modified in the manner shown in FIGS. 11 and 12: the holes 22 are omitted; each passage 8B-1 comprises at its base an outlet opening 17B-1 and an oblique undulating member 18B as in FIGS. 1–4, and each of the passages 8B-2 comprises at its base an inlet opening 17B-2. It will be noted that the box 5 of FIGS. 2–4 covers all the openings 17B-1 and 17B-2. Moreover, the lower part of the passages 8B-2 comprises an undulant member 23 with horizontal generatrices, for example, as shown, of the "serrated" type, that is to say comprising at regular intervals openings offset vertically by a quarter of the pitch of the undulation.

As another variant (FIGS. 13 and 14), the vertical strips 10 can be provided only between the passages 8A-1 and 8B-1, no closure separating the passages 8A-2 and 8B-2, which latter comprise only a common vertical imperforate undulation and, in their lower part, a horizontal undulation 24 of triangular shape which extends over all the width of the exchanger.

In such a variant, in one out of two passages, the liquid oxygen follows a descending path in zone 8B-2, horizontal along undulation 24, then ascending in the zone 8A-2. In this latter zone, the liquid oxygen will be in indirect heat exchange with the nitrogen which condenses in the passages 8A-1, and the passages 8B-1 are dead zones, which can open upwardly and accordingly fill with liquid oxygen, as shown, or even, as a modification, be closed at their two ends.

FIG. 15 shows schematically the use of a plate exchanger as a dephlegmater, for example to produce nitrogen. In one out of two passages, the air, introduced under about six bars absolute, is partially condensed while rising, as shown by the arrows 25, which produces at the bottom of these passages "rich liquid" (air enriched in oxygen) LR and, at the top of these same passages, gaseous nitrogen NG.

To ensure condensation of the air, the rich liquid is expanded to one bar absolute in expansion valve 26, which flashes it. The upper part of the recited passages is used to separate the two phases, which are then recombined in the remaining passages, in which the refrigerant low pressure two-phase rich liquid circulates from top to bottom then is evacuated in the form of vaporized rich liquid LVR.

Figure 16:
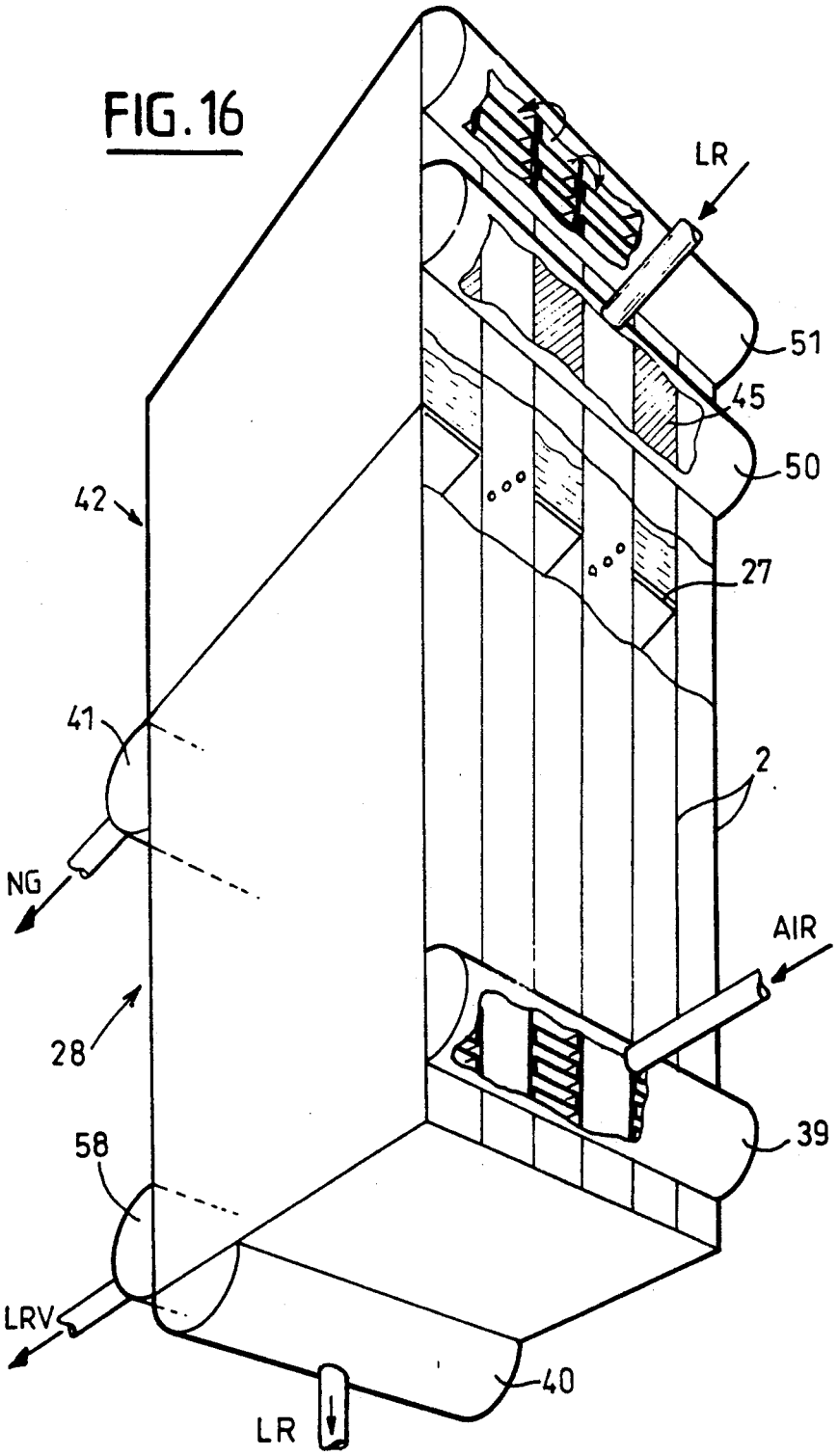
FIG. 16 is a view similar to FIG. 1 of this third embodiment.
Figure 17:
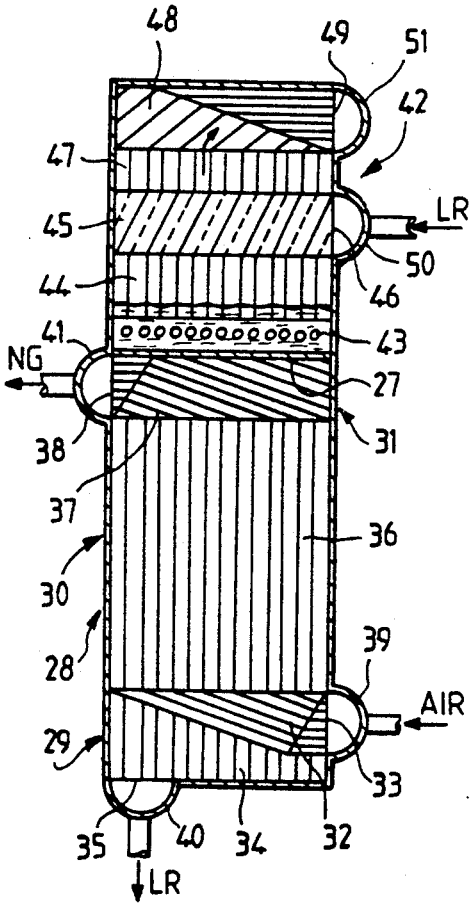
FIGS. 17 and 18 show respectively, in vertical cross section, the two types of passages of the exchanger of FIG. 16.
Figure 18:
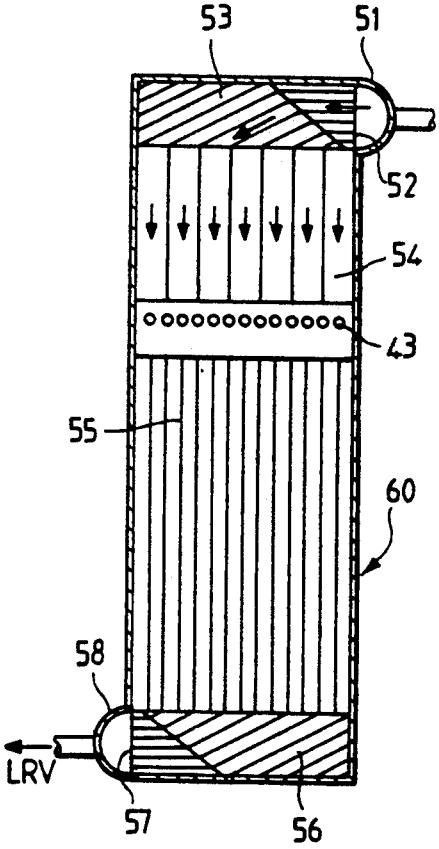

The construction of the heat exchanger is shown in FIGS. 16–18.

One out of two passages (FIG. 17) is subdivided in two parts by a horizontal strip 27:

(1) a principal heat exchange part 28, extending from the base of the exchanger, which comprises, from bottom to top, a zone 29 for air distribution and collection of rich liquid, a dephlegmation zone 30 and a zone 31 for collection and evacuation of gaseous nitrogen. The zone 29 contains an oblique perforated undulation 32 opening on a lateral opening 33 for air inlet and, below this undulation, a vertical undulation 34 which opens on a lower opening 35 for the outlet of rich liquid. The zone 30 contains a vertical undulation 36, and zone 31 contains an oblique undulation 37 opening on a lateral opening 38 for evacuation of nitrogen. The boxes 39 for inlet of air, 40 for outlet of rich liquid and 41 for nitrogen outlet communicate respectively with the openings 33, 35 and 38.

(2) an added upper part 42 comprising a phase separator. This part contains, from bottom to top a zone of low height, without an undulation, in which each vertical plate has a horizontal row of holes 43, a zone containing a vertical undulation 44, a zone containing a "serrated" undulation 45 with oblique generatrices, communicating with a lateral inlet opening 46, containing a vertical undulation 47, and a zone containing an oblique undulation 48 opening on the outlet opening 49. Boxes 50 for inlet of two-phase rich liquid and 51 for outlet of vaporized rich liquid extend over the openings 46 and 49 respectively.

The remaining passages 60 (FIG. 18) comprise, from top to bottom, an inlet zone for vaporized rich liquid communicating with a lateral inlet opening 52 and containing an oblique undulation 53, a zone containing a vertical undulation 54, a zone without undulation, of low height, into which open the holes 43, a thermal exchange zone with a vertical undulation 55, and a vaporized rich liquid outlet zone containing an oblique undulation 56 which opens onto an outlet opening 57. The box 51 communicates also with openings 52, and an outlet box 58 communicates with openings 57.

When the expanded rich liquid enters in two-phase form the box 50 then the zones 42 of FIG. 17, it there encounters a mass of small obstacles created by the splits of the "serrated" undulant member 46. This effects the separation of its two phases. The liquid phase collects on the strip 27 and, passing through the holes 43, enters in the form of jets, the adjacent passages 60 of FIG. 18. At the same time, the vapor phase is directed by the box 51 to the openings 52 of these adjacent passages, such as this vapor circulates downwardly along the undulations 54 and recombines with the liquid at the holes 43, to form a refrigerant two-phase liquid which vaporizes while descending along the undulations 55.

In a modification which is not shown, the separation zone of the phases 42 can be used to return the separated vapor phase, via the box 51 and the passages containing the undulation 54, to a different level of the exchanger, for example to its lower end. In this case, the vapor phase leaves laterally of that level, collected by an outlet box and sent by this latter into other passages of the exchanger.

What is claimed is:

1. An indirect heat exchanger comprising a series of parallel plates delimiting between themselves passages of generally flat form containing undulant spacers, a first series of said passages constituting thermal exchange passages, inlet/outlet means for inlet and outlet of fluids adapted to exchange heat with each other; and further comprising over at least a portion of its length and of its width, added passages in reduced or no heat exchange relation with the thermal exchange passages and fulfilling at least one fluid handling function within the heat exchanger.

2. Heat exchanger according to claim 1, wherein the added passages are thicker than the thermal exchange passages.

3. Heat exchanger according to claim 1, wherein the added passages contain undulant members of greater pitch than those of the thermal exchange passages.

4. Heat exchanger according to claim 1, wherein all the added passages are adjacent to each other.

5. Heat exchanger according to claim 1, wherein the added passages are distinct from the thermal exchange passages and, like these latter, extend each over all the length and over all the width of the exchanger.

6. Heat exchanger according to claim 1, wherein at least certain passages of the exchanger constitute over a portion of the width of the latter a thermal exchange passage and over the rest of its width an added passage.

7. Heat exchanger according to claim 1, wherein at least certain passages of the exchanger constitute over a portion of the length of the latter a thermal exchange passage and over the rest of its length an added passage.

8. An indirect heat exchanger comprising a series of parallel plates delimiting between themselves passages of generally flat form containing undulant spacers, a first series of said passages constituting thermal exchange passages, inlet/outlet means for inlet and outlet of fluids adapted to exchange heat with each other; wherein, over at least a portion of its length and of its width, said exchanger has added passages, in reduced or no heat exchange relation with the thermal exchange passages and fulfilling at least one function in addition to the exchange of heat, said added passages comprising liquid vapor separation passages which contain a packing for liquid/vapor separation disposed facing an inlet opening of two-phase liquid.

9. Heat exchanger according to claim 8, wherein the packing is constituted by a "serrated" undulant member with oblique generatrices.

10. Heat exchanger according to claim 8, wherein the liquid-vapor separation passages comprise at the upper end an opening for the outlet of vapor covered by an outlet box, said outlet box communicating with return passages for vapor to a different level of the exchanger.

* * * * *